US011236291B2

(12) United States Patent
Sun et al.

(10) Patent No.: US 11,236,291 B2
(45) Date of Patent: Feb. 1, 2022

(54) MODERATELY ALKALINE CLEANING COMPOSITIONS FOR PROTEINACEOUS AND FATTY SOIL REMOVAL AT LOW TEMPERATURES

(71) Applicant: ECOLAB USA INC., Saint Paul, MN (US)

(72) Inventors: Xin Sun, Saint Paul, MN (US); Jacquilyne Gandara, Saint Paul, MN (US); Robert J. Ryther, Saint Paul, MN (US); Thomas R. Mohs, Saint Paul, MN (US); Walter D. Cummings, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 16/857,274

(22) Filed: Apr. 24, 2020

(65) Prior Publication Data

US 2020/0255768 A1 Aug. 13, 2020

Related U.S. Application Data

(63) Continuation of application No. 15/710,471, filed on Sep. 20, 2017, now Pat. No. 10,676,695, which is a (Continued)

(51) Int. Cl.
*C11D 1/75* (2006.01)
*C11D 3/08* (2006.01)

(Continued)

(52) U.S. Cl.
CPC ..... *C11D 3/044* (2013.01); *B08B 3/08* (2013.01); *C11D 1/75* (2013.01); *C11D 3/046* (2013.01);

(Continued)

(58) Field of Classification Search
CPC .... C11D 1/14; C11D 1/22; C11D 1/29; C11D 1/75; C11D 3/044; C11D 3/10; C11D 3/3953; C11D 3/3955; C11D 3/3956

(Continued)

(56) References Cited

U.S. PATENT DOCUMENTS 3,341,459 A 9/1967 Davis
3,843,563 A 10/1974 Davies et al.

(Continued)

FOREIGN PATENT DOCUMENTS

CN 1219958 A 6/1996
CN 101171329 A 4/2008

(Continued)

OTHER PUBLICATIONS

Bird, M.R., et al., "An Experimental Study of the Cleaning of Surfaces Fouled by Whey Proteins", Institute of Chemical Engineers, pp. 13-21. Dec. 31, 2005.

(Continued)

*Primary Examiner* — Gregory R Delcotto
(74) *Attorney, Agent, or Firm* — McKee, Voorhees & Sease, PLC

(57) ABSTRACT

The present invention comprises chlorinated and non-chlorinated alkaline cleaning compositions for removal of proteinaceous and fatty soils at low temperature, i.e. less than 120° F., with little or no deleterious affect on cleaning performance. According to the invention, applicants have found that adding additional alkalinity makes protein removal more difficult and reducing the amount of alkalinity actually improves performance. According to the invention optimized combinations of chlorine and alkalinity components for low temperature cleaning as well as a surfactant system optimized for low temperature fatty soil removal are disclosed.

2 Claims, 5 Drawing Sheets

Figure 1:
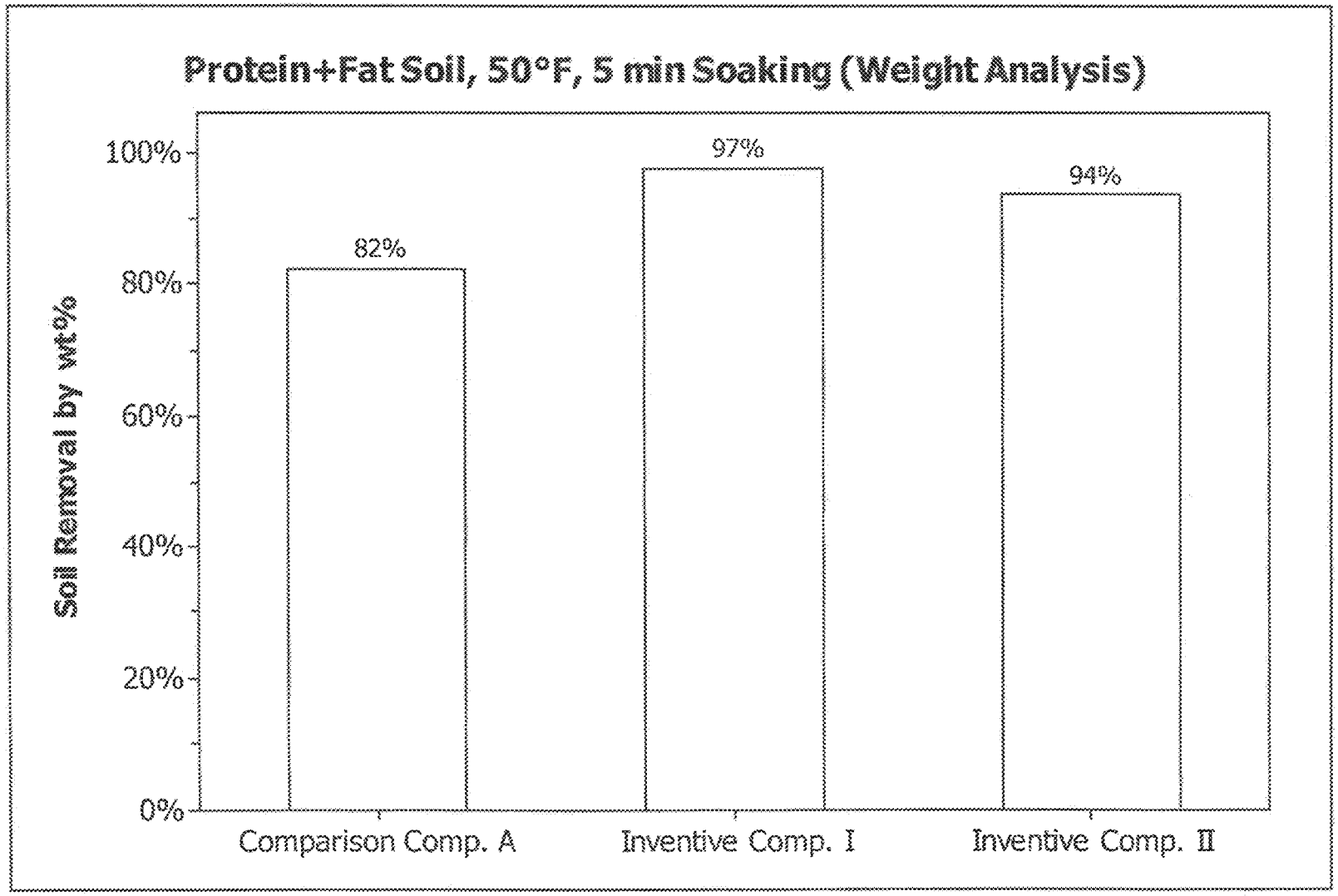

Related U.S. Application Data continuation of application No. 14/750,188, filed on Jun. 25, 2015, now Pat. No. 9,803,160, which is a continuation of application No. 13/271,861, filed on Oct. 12, 2011, now abandoned.

(51) Int. Cl.

| | |
|---|---|
| ***C11D 3/10*** | (2006.01) |
| ***C11D 3/04*** | (2006.01) |
| ***C11D 3/395*** | (2006.01) |
| ***C11D 3/06*** | (2006.01) |
| ***C11D 3/24*** | (2006.01) |
| ***C11D 3/28*** | (2006.01) |
| ***C11D 3/32*** | (2006.01) |
| ***C11D 7/06*** | (2006.01) |
| ***C11D 7/12*** | (2006.01) |
| ***C11D 7/14*** | (2006.01) |
| ***C11D 7/16*** | (2006.01) |
| ***C11D 7/28*** | (2006.01) |
| ***C11D 7/32*** | (2006.01) |
| ***B08B 3/08*** | (2006.01) |
| ***C11D 3/30*** | (2006.01) |

(52) U.S. Cl.

CPC ..... *C11D 3/06* (2013.01); *C11D 3/08* (2013.01); *C11D 3/10* (2013.01); *C11D 3/24* (2013.01); *C11D 3/28* (2013.01); *C11D 3/30* (2013.01); *C11D 3/32* (2013.01); *C11D 3/3951* (2013.01); *C11D 3/3953* (2013.01); *C11D 3/3955* (2013.01); *C11D 3/3956* (2013.01); *C11D 3/3958* (2013.01); *C11D 7/06* (2013.01); *C11D 7/12* (2013.01); *C11D 7/14* (2013.01); *C11D 7/16* (2013.01); *C11D 7/28* (2013.01); *C11D 7/3209* (2013.01); *C11D 7/3263* (2013.01); *C11D 7/3281* (2013.01)

(58) Field of Classification Search

USPC ..... 510/221, 225, 237, 238, 303, 336, 337, 510/420, 433, 435, 503

See application file for complete search history.

(56) References Cited

U.S. PATENT DOCUMENTS

| | | | | |
|---|---|---|---|---|
| 4,592,785 | A | 6/1986 | Reinert et al. | |
| 5,391,326 | A | 2/1995 | Smith et al. | |
| 5,624,891 | A | 4/1997 | Smialowicz et al. | |
| 5,710,120 | A | 1/1998 | Kanluen et al. | |
| 5,858,117 | A | 1/1999 | Oakes et al. | |
| 5,929,007 | A | 7/1999 | Feng | |
| 5,935,920 | A | 8/1999 | Geke et al. | |
| 5,939,375 | A | 8/1999 | Muller et al. | |
| 6,718,992 | B1 | 4/2004 | Cardola et al. | |
| 6,812,202 | B2 | 11/2004 | Man et al. | |
| 6,825,159 | B2 | 11/2004 | Man et al. | |
| 6,956,016 | B2 | 10/2005 | Speed et al. | |
| 7,378,380 | B2 | 5/2008 | Biagg et al. | |
| 7,507,697 | B1 | 3/2009 | Shertok et al. | |
| 9,803,160 | B2 * | 10/2017 | Sun | C11D 3/28 |
| 10,676,695 | B2 * | 6/2020 | Sun | C11D 7/14 |
| 2004/0077516 | A1 | 4/2004 | Man et al. | |
| 2005/0130863 | A1 | 6/2005 | Blagg et al. | |
| 2006/0199755 | A1 | 9/2006 | Rees et al. | |
| 2006/0276366 | A1 | 12/2006 | Deljosevic et al. | |
| 2008/0045433 | A1 | 2/2008 | Blagg et al. | |
| 2009/0099057 | A1 | 4/2009 | DeDominicis et al. | |
| 2009/0298738 | A1 | 12/2009 | Kneipp et al. | |
| 2010/0305017 | A1 | 12/2010 | Monken | |
| 2010/0317559 | A1 | 12/2010 | Ryther et al. | |
| 2011/0027194 | A1 | 2/2011 | Smith et al. | |
| 2011/0180619 | A1 | 7/2011 | Konishi et al. | |

FOREIGN PATENT DOCUMENTS

| | | | |
|---|---|---|---|
| DE | 19803054 | A1 | 7/1999 |
| EP | 1104802 | A1 | 6/2001 |
| WO | 8805461 | A1 | 7/1988 |
| WO | 9830672 | A1 | 7/1998 |
| WO | 0170821 | A3 | 9/2001 |
| WO | 0170921 | A2 | 9/2001 |
| WO | WO2011027170 | A3 | 3/2011 |

OTHER PUBLICATIONS

Mercade-Prieto, Ruben et al., "Probing the Mechanisms Limiting Dissolution of Whey Protein Gels During Cleaning" Department of Chemical Engineering & Biotechnology, pp. 261-268. Dec. 31, 2005.

Mercade-Prieto, Ruben et al., "The Poor Performance of NaOH in the Dissolution of Whey Protein Gels at Very High pH", ECI Symposium Series, vol. RP2 Proceedings of 6th Intl Conf on Heat Exchanger Fouling Jun. 5, 2005.

Mercade-Prieto, R. et al., "The Science of Cleaning of Dairy Fouling Layers", ECI Symposium Series, vol. RP5: Proceedings of 7th International Conference on Heat Exchanger Fouling and Cleaning—Challenges and Opportunities, Jul. 1, 2007.

International Searching Authority,"Notification of Transmittal of The International Search Report and The Written Opinion" issued in connection to International Application No. PCT/US2012/059665, dated Mar. 25, 2013.

European Patent Office, "European Search Report" issued in connection with International Application No. PCT/US2012/059665, 8 pages, dated May 20, 2015.

European Patent Office, "Supplemental European Search Report" issued in connection with International Applciation No. EP 12 84 0542, 8 pages, dated May 6, 2015.

* cited by examiner

MODERATELY ALKALINE CLEANING COMPOSITIONS FOR PROTEINACEOUS AND FATTY SOIL REMOVAL AT LOW TEMPERATURES

CROSS REFERENCE TO RELATED APPLICATIONS

This is a Continuation Application of U.S. Ser. No. 15/710,471, filed Sep. 20, 2017, now U.S. Pat. No. 10,676,695, which is a continuation of U.S. Ser. No. 14/750,188 filed Jun. 25, 2015, now U.S. Pat. No. 9,803,160, issued Oct. 31, 2017, which is a continuation of U.S. Ser. No. 13/271,861 filed Oct. 12, 2011, now abandoned, all of which are herein incorporated by reference in their entirety.

FIELD OF THE INVENTION

The invention relates to cleaning compositions and, more particularly, to alkaline cleaning compositions that provide improved protein and fat soil removal at low temperature.

BACKGROUND OF THE INVENTION

Aqueous cleaning compositions that are formulated for removing fatty soils from a variety of substrates have been developed and have been used for many years. A large variety of different types of formulations have been developed to remove fat containing soils from a variety of surfaces.

One type of cleaner for fatty soil are highly alkaline institutional cleaners that chemically saponify fats and remove the saponification reaction products which are more water soluble than the fat precursor. These materials operate using strong bases such as a sodium or potassium hydroxide or silicate in combination with other soil suspending and removing compositions. Other types have included active enzyme compositions which act to remove fat from a substrate by the natural action of the enzyme in breaking the fat down into its constituent substances which can be removed by surfactants or other components in a formulated cleaner. Desirable cleaners, however, remove both protein and fat containing soils.

Proteins are by far the most difficult soils to remove in the food industry and others. In fact, casein (a major milk protein) is used for its adhesive properties in many glues and paints. Food proteins range from simple proteins, which are easier to remove, to more complex proteins, which are very difficult to remove. Heat-denatured proteins can be extremely difficult as they create a protein film which makes the proteins especially difficult for cleaners to reach. Protein soils from milk, eggs, meat etc., can be solubilized by alkaline solutions. Proteins hydrate and swell when they come into contact with water which helps alkalis to react with them, forming soluble salts.

Generally, a highly alkaline detergent with peptizing or dissolving properties is required to remove protein soils. Wetting agents can also be used to increase the wettability and suspendability of proteins. Protein films, which tend to be created at higher temperatures when proteins become denatured, require alkaline cleaners which have hypochlorite in addition to wetting agents. Chlorine is typically employed to degrade protein by oxidative cleavage and hydrolysis of the peptide bond, which breaks apart large protein molecules into smaller peptide chains. The conformational structure of the protein disintegrates, dramatically lowering the binding energies, and effecting desorption from the surface, followed by solubilization or suspension into the cleaning solution.

Temperature is extremely significant in cleaning operations. Too high of a temperature can cause excess denaturing of proteins and the creation of protein films which are difficult to remove. In general, however, increasing the temperature decreases the strength of bonds between the soil and the surface, decreases viscosity and increases turbulent action, increases the solubility of soluble materials, and increases chemical reaction rates. Higher temperatures are generally beneficial, as long as they are not so high as to cause protein denaturation. Higher temperatures are also costly to employ and difficult to maintain consistently.

A balance must be struck between higher temperature with increased soil removal efficiency and the higher cost and difficulties of maintaining the same. Cleaning methods differ with respect to whether the soil is cleaned in an automated (clean-in-place or CIP) process or manually. Automated cleaning can be done safely at temperatures up to or exceeding (under high pressure) the boiling point of water. Cleaning solutions as well as final rinse water can be heated to facilitate soil removal and equipment surfaces holding the food soil are heated as well, also facilitating the cleaning process. As automated systems can recirculate cleaning solution, the mechanical solution flow supports the removal of soil. In addition, the ability to re-heat the cleaning solution, by passing it through a heat exchanger during the cleaning operation, supports the removal of soil by keeping the equipment surfaces at a constant and high cleaning temperature.

For manual cleaning operations, especially in open, large facility environments, cleaning does not generally benefit by heating the chemical cleaning solution as the large surface areas to be cleaned will rapidly cool the solution to ambient temperature. In such cleaning operations, chemical residence time on a surface (often in the form of foam or a gel, especially for vertical surfaces) and high temperature rinse water is required to effectively clean a surface. Unfortunately for these types of manual cleaning operations, rinse water temperature is usually limited at the high end to between 120° F. and 140° F. for employee safety reasons. Without the ability to recirculate the hot water, as is common in automated operations, a much higher amount of water is required to heat up a soiled surface for these environmental areas and the costs of heating cold water to these temperatures can be significant.

As can be seen, there is a need in the art for alkaline cleaning compositions that can clean these environmental surfaces and remove proteins and fats at lower temperatures (i.e. less than 120° F.) and even as low as 50° F. without a decrease in cleaning performance.

SUMMARY OF THE INVENTION

The present invention comprises moderately alkaline cleaning compositions with and without chlorine for removal of proteinaceous and fatty soils at lower temperatures on environmental surfaces of a food processing facility. These surfaces can include equipment surfaces not cleaned by automated clean-in-place systems, external surfaces of equipment, conveyors systems, walls, floors, ceilings, elevated walkways, drains, piping and conduit etc. Cleaning these surfaces at reduced temperature can result in significant savings for a food processing operation.

According to one aspect of the invention, applicants have found that having excess amount of alkalinity in typically alkaline-chlorine cleaning compositions actually makes protein soil removal from surfaces more difficult. Applicants also found that reducing the amount of alkalinity significantly improved performance at lower temperatures than what is typical for standard cleaning compositions. This is unexpected as typical thinking was that at a lower temperature, additional alkalinity would need to be added to maintain cleaning performance.

According to an aspect of the invention, optimized combinations of chlorine and alkalinity components for low temperature cleaning include a reversal of the traditional ratio of chlorine and alkalinity. A ratio of ppm chlorine as sodium hypochlorite to ppm alkalinity of greater than 1:1 on a percent weight basis was found to demonstrate superior cleaning than traditional alkaline chlorine cleaners at temperatures as low as 50° F. In a preferred embodiment the ratio of ppm chlorine as sodium hypochlorite to ppm alkalinity is 3:1 or greater and in a most preferred embodiment the ratio is 5:1 or greater.

Cleaning compositions according to this aspect of the invention comprise: (a) an alkaline portion containing a source of alkalinity selected from the group comprising alkali or alkaline earth metal borate, silicate, carbonate, hydroxide, phosphate and mixtures and combinations thereof; (b) a portion containing a source of chlorine such as a hypochlorite salt, a chlorinated phosphate, a chlorinated isocyanurate, a chlorinated melamine, a chlorinated amide, and the like, or mixtures and combinations thereof, wherein the ratio of chlorine to active alkalinity is greater than 1:1, preferably 3:1 or greater, and most preferably 5:1 or greater; (c) an optional surfactant system optimized for both increasing the wetting rate of protein soils by chlorine and alkaline sources as well as emulsification of fat soils; (d) optional additives providing features such as, for example, formula tolerance to water hardness (water conditioning agents), additives that can provide stability to a pre-dilution concentrate form of the formula (co-surfactants and/or hydrotropes), additives affecting the residence time of a cleaning solution on surfaces to be cleaned (such as foaming or gelling agents) as well as additives that provide additional properties to the cleaning such as antimicrobial properties (such as peracid, quaternary ammonium, amines, etc.) or surface conditioners or corrosion inhibitors (such as silicates)

Similarly, according to another aspect of the invention, applicants have also found that in alkaline cleaning compositions without chlorine, adding additional alkalinity makes protein soil removal more difficult. Applicants also found that reducing the amount of alkalinity significantly improved protein soil removal performance at lower temperatures such as 50° F. and that an appropriately chosen surfactant system can replace the removed alkalinity for emulsification of fat soils. Cleaning compositions would include (a) an alkaline portion containing a source of alkalinity selected from the group comprising alkali or alkaline earth metal borate, silicate, carbonate, hydroxide, phosphate and mixtures and combinations thereof; (b) a surfactant or surfactant system and (c) optional additives providing features such as, for example, formula tolerance to water hardness (water conditioning agents), additives that can provide stability to a pre-dilution concentrate form of the formula (co-surfactants and/or hydrotropes), additives affecting the residence time of a cleaning solution on surfaces to be cleaned (such as foaming or gelling agents), additives that provide additional properties to the cleaning such as antimicrobial properties (such as peracid, quaternary ammonium, amines, etc.) or surface conditioners or corrosion inhibitors (such as silicates) as well as additives providing non-chlorine oxidation (such as peroxide or other non-chlorine oxidizers). In cleaning solutions at use concentrations, the active alkalinity level is adjusted to be in the range of approximately 50-10000 ppm, preferably 100-5000 ppm, and most preferably 250-2000 ppm.

These formulations with and without chlorine are much less alkaline than typical chlorinated and non-chlorinated alkaline cleaning compositions which can use over 10000 ppm active alkalinity. This lower level of alkalinity can provide significant reduction in corrosion of cleaning surfaces and the like and less wear and tear on cleaned surfaces.

In another embodiment, the present invention is a method of removing proteinaceous soils from a surface. The method includes contacting the surface with the chlorinated and/or non-chlorinated alkaline cleaning compositions of the invention and then rinsing the surface. Preferably this is done at temperatures of less than 120° F. and in some cases lower than 50° F. The compositions and methods are useful in cleaning household, institutional, and industrial hard surfaces including clean-in-place systems and food processing equipment. Additional uses include as a general hard surface cleaner, environmental cleaner, drain cleaner and the like. The compositions are useful in solid or liquid state as is further described below.

According to yet another aspect of the invention, applicants have identified a surfactant system that provides superior fatty soil removal at low temperature such as 80° F. or lower in either chlorinated or non-chlorinated alkaline cleaning compositions.

Applicants have determined that amine oxide surfactants are superior to other surfactants in removing fatty soils at low temperature. Further, applicants found that longer alkyl chain amine oxides (i.e. C14 or greater) are superior to shorter amine oxides (i.e. C12 etc.) in fatty soil removal. According to the invention, the most preferred amine oxide surfactant has at least 50% of the carbon chain lengths of 14 or greater.

Cleaning compositions according to this aspect of the invention comprise: (a) an alkaline portion containing a source of alkalinity selected from the group comprising alkali or alkaline earth metal borate, silicate, carbonate, hydroxide, phosphate and mixtures and combinations thereof; (b) a surfactant system comprising a long chain amine oxide, optionally, (c) a source of chlorine such as a hypochlorite, a chlorinated phosphate, a chlorinated isocyanurate, a chlorinated melamine, a chlorinated amide, and the like, or mixtures and combinations thereof, and optionally, (d) additives providing features such as, for example, formula tolerance to water hardness (water conditioning agents), additives that can provide stability to a pre-dilution concentrate form of the formula (co-surfactants and/or hydrotropes) or additives that provide additional properties to the cleaning such as antimicrobial properties (such as peracid, quaternary ammonium, amines, etc.) or surface conditioners or corrosion inhibitors (such as silicates) as well as additives affecting the residence time of a cleaning solution on surfaces to be cleaned (such as foaming or gelling agents).

In another embodiment, the present invention is a method of removing fatty soils from a surface. The method includes contacting the surface with the chlorinated and/or non-chlorinated alkaline cleaning compositions of the invention comprising a long chain amine oxide surfactant and then rinsing the surface. Preferably this is done at temperatures of less than 120° F. to as low as 80° F. The compositions and methods are useful in cleaning household, institutional, and industrial hard surfaces including clean-in-place systems and food processing equipment. Additional uses include as a general hard surface cleaner, environmental cleaner, drain cleaner and the like. The compositions are useful in solid or liquid state as is further described below.

Finally, one or more aspects of the compositions and methods above may be combined to provide optimized cleaning of both protein and fatty soils at low temperatures with a mildly alkaline cleaning composition.

While multiple embodiments are disclosed, still other embodiments of the present invention will become apparent to those skilled in the art from the following detailed description, which shows and describes illustrative embodiments of the invention. Accordingly, the description which follows is to be regarded as illustrative in nature and not restrictive.

DETAILED DESCRIPTION OF THE FIGURES

FIG. 1 is a graph of the soil removal results from stainless steel coupon cleaning experiments using weight analysis for comparison composition A and inventive compositions I and II on a protein and fat mixed soil at 50° F. Weight analysis demonstrates the ability of the cleaning solution to dissolve the bulk soil from a hard surface but not necessarily complete removal from any portion of that surface. Cleaning with Inventive Composition I and II both showed higher wt % removed soil compared to the Comparison Composition A.

Figure 2:
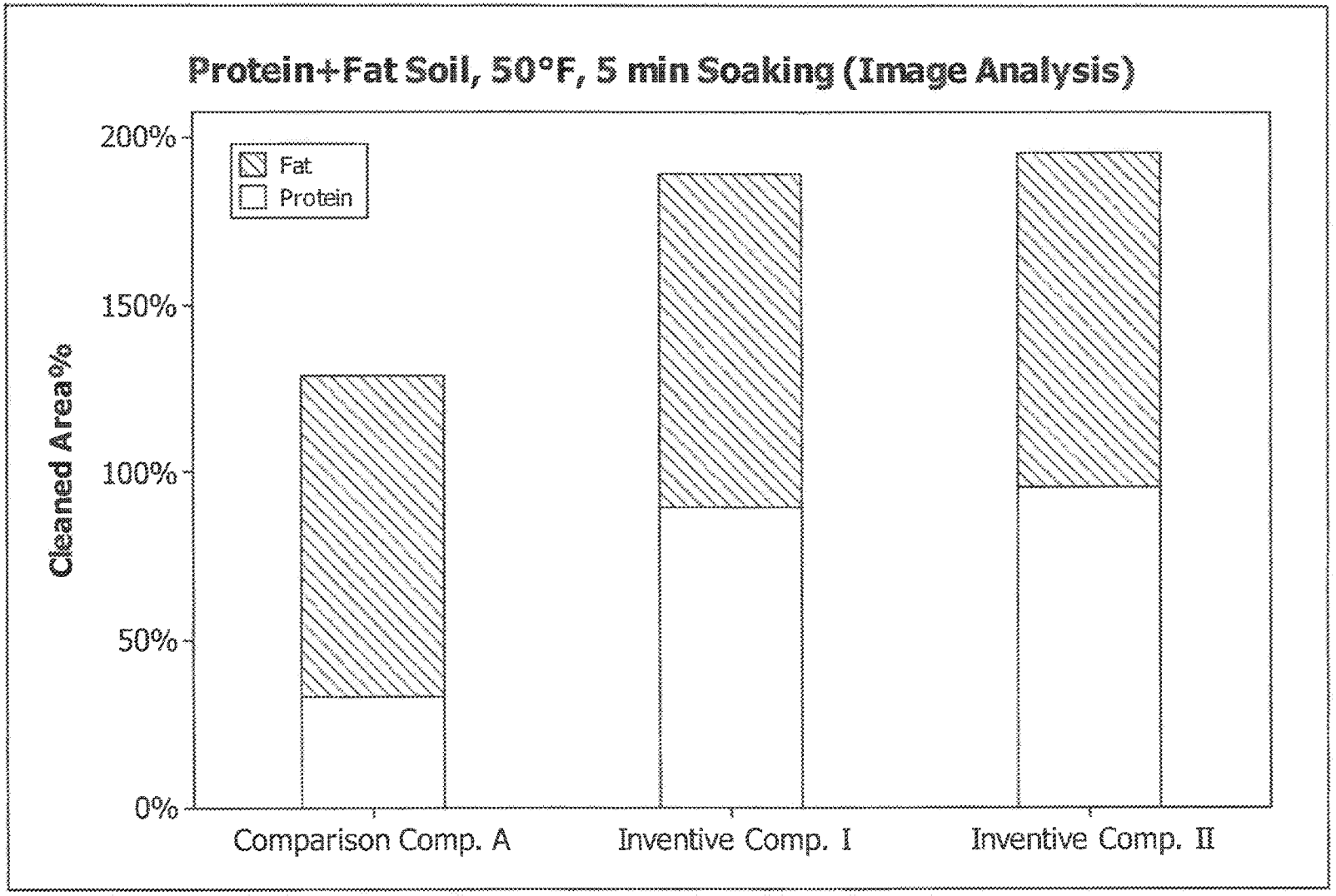

FIG. 2 is a graph of the image analysis results from the same cleaning experiment used in FIG. 1. Protein and fat staining methods were used on the cleaned coupons and results for each staining method described above are summed for each cleaning composition (each staining method resulting in 100% maximum representing complete removal of protein soil or fat soil and a total of 200% maximum for complete removal of both protein and fat soils from a coupon surface). Cleaning with Inventive Composition I and II both showed higher cleaned area % for protein+fat soils than did the Comparison Composition A.

Figure 3:
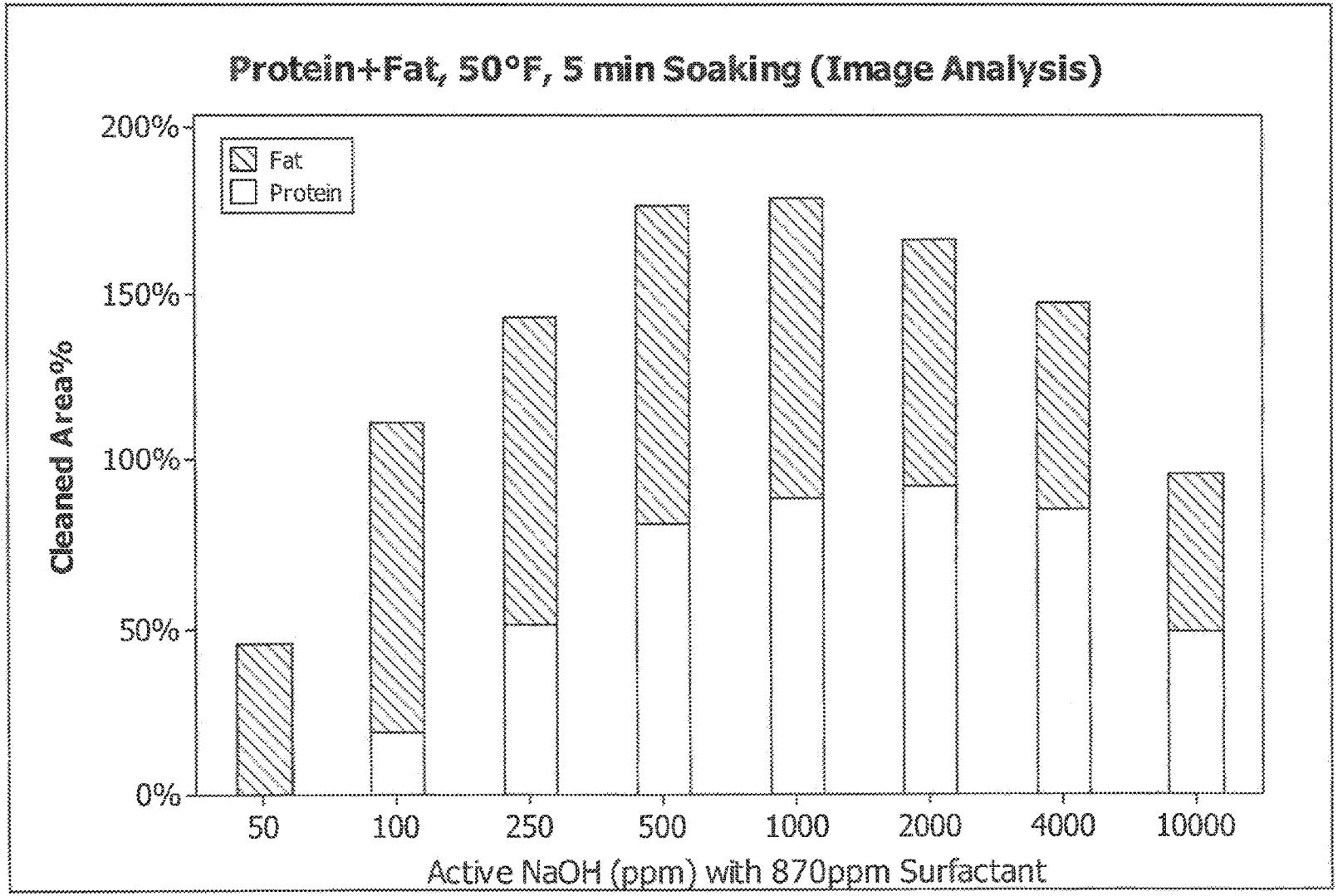

FIG. 3 is a graph of the image analysis results for coupons cleaned by various levels of active alkalinity in the presence of 870 ppm surfactant at 50° F. on protein+fat soils. Cleaned area % was maximized at a level centering at 1000 ppm. Additional alkalinity had the effect of decreasing the cleaning performance.

Figure 4:
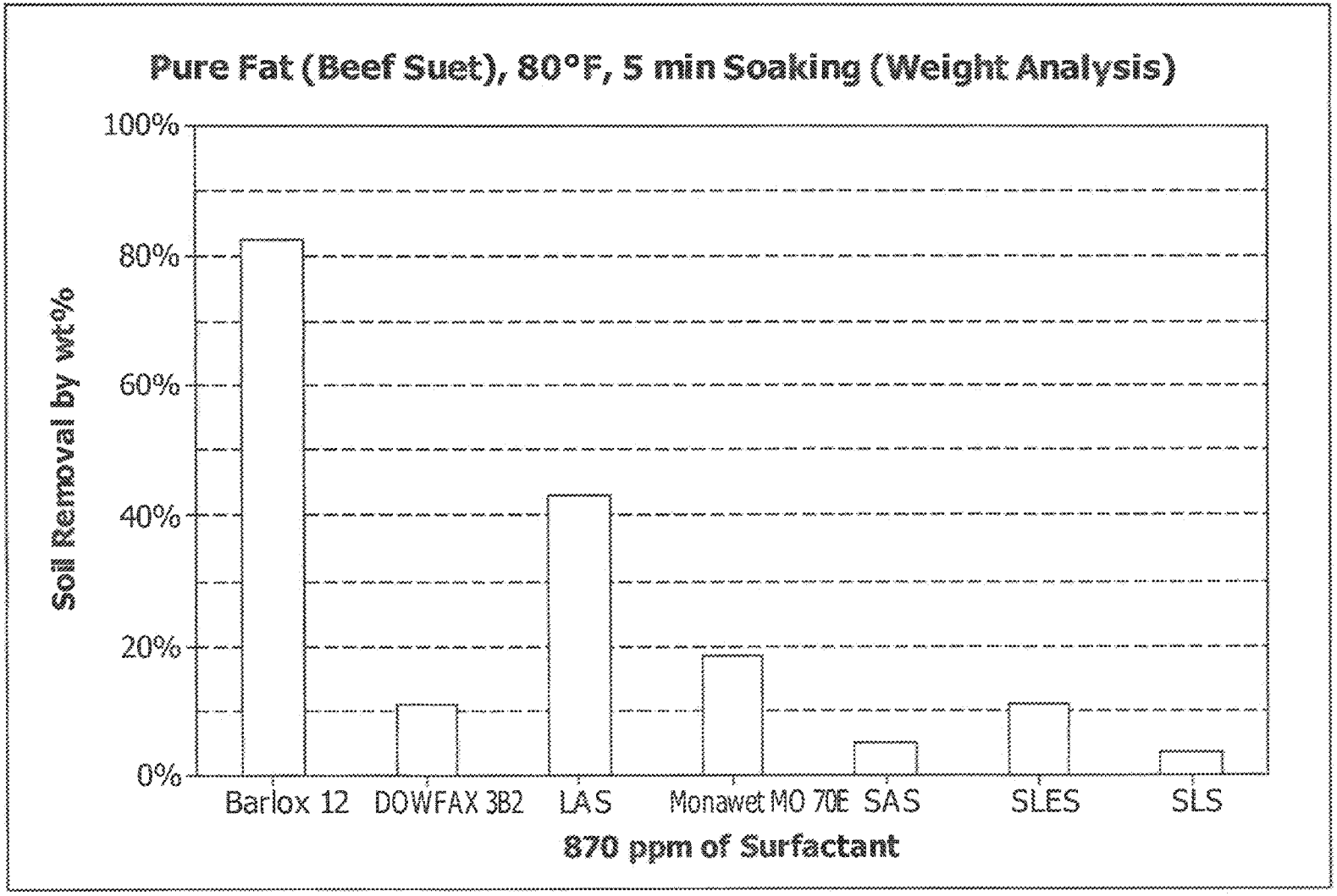

FIG. 4 is a graph of the soil removal weight analysis results on fat (beef suet) at 80° F. by using different types of surfactants at active level of 870 ppm each. Surfactants Amine Oxide (Barlox 12), Alkyldiphenyloxide Disulfonate (Dowfax 3B2), Linear Alkylbenzene Sulfonate (LAS), Sodium Lauryl Sulfate (SLS), Sodium Lauryl Ether Sulfate (SLES), Secondary Alkyl Sulfate (SAS), Sulfosuccinate (Monawet MO 70E) were tested. The amine oxide type surfactant (Barlox 12) showed increased cleaning compared to other surfactants tested.

Figure 5:
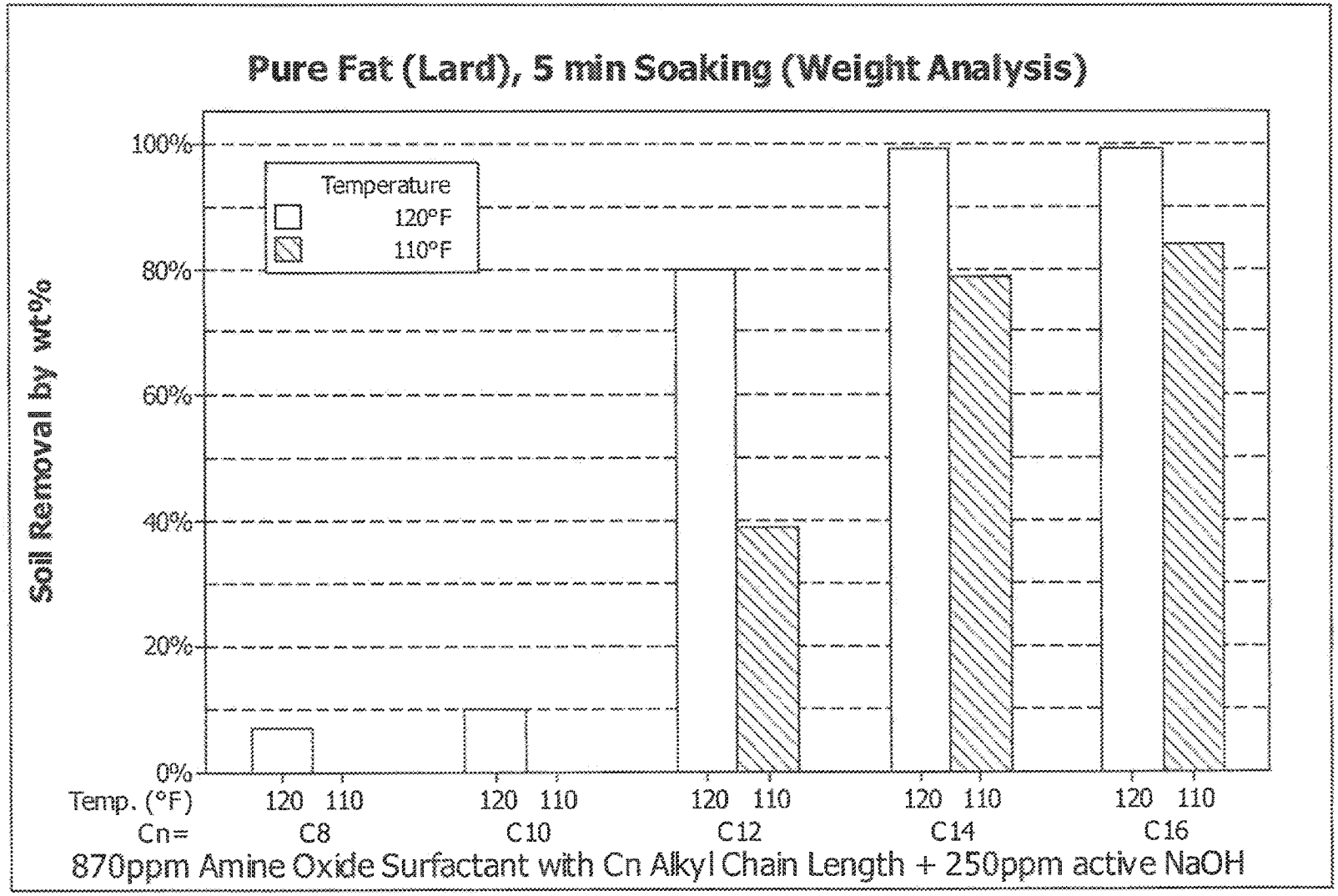

FIG. 5 is a graph of soil removal weight analysis results on fat (lard) at 110° F. or 120° F. by amine oxide surfactants containing various alkyl chain lengths (i.e. C8, C10, C12, C14, etc.) with the presence of 250 ppm of active alkalinity. Surfactants tested here are from Lonza. FMB AM-8 contains mainly alkyl chain of 8 carbons. Barlox 10 contains mainly alkyl chain of 10 carbons. Barlox 12 contains mainly alkyl chain of 12 carbons. Barlox 14 and 16s contain mainly alkyl chain of 14 and 16 carbons, respectively. The graph demonstrates clearly that amine oxide surfactant containing longer alkyl chain (C14, 16) had superior fat removal performance compared to short alkyl chain counterparts (C10, 12).

DETAILED DESCRIPTION OF INVENTION

For the following terms, these meanings shall be applied, unless a different meaning is given or indicated in the claims or elsewhere in this specification. Other than in the operating examples, or where otherwise indicated, all numbers expressing quantities of ingredients or reaction conditions used herein are to be understood as being modified in all instances by the term "about".

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities.

The term "surfactant" or "surface active agent" refers to an organic chemical that when added to a liquid changes the properties of that liquid at a surface.

"Cleaning" means to perform or aid in soil removal, bleaching, microbial population reduction, rinsing, or combination thereof.

As used herein, the term "hard surface" includes showers, sinks, toilets, bathtubs, countertops, windows, mirrors, transportation vehicles, floors, food manufacturing equipment (usually stainless steel), walls, ceiling, piping, conduit, any surface that can get soiled in a food production environment and the like. These surfaces can be those typified as "hard surfaces" (such as walls, floors, bed-pans).

As used herein, the terms "active chlorine", "chlorine", and "hypochlorite" are all used interchangeably and are intended to mean measurable chlorine available in a use solution as evaluated by standard titration techniques known to those of skill in the art.

As used herein, a solid cleaning composition refers to a cleaning composition in the form of a solid such as a powder, a particle, an agglomerate, a flake, a granule, a pellet, a tablet, a lozenge, a puck, a briquette, a brick, a solid block, a unit dose, or another solid form known to those of skill in the art. The term "solid" refers to the state of the cleaning composition under the expected conditions of storage and use of the solid detergent composition. In general, it is expected that the detergent composition will remain in solid form when exposed to temperatures of up to about 100° F. and greater than about 120° F. A cast, pressed, or extruded "solid" may take any form including a block. When referring to a cast, pressed, or extruded solid it is meant that the hardened composition will not flow perceptibly and will substantially retain its shape under moderate stress or pressure or mere gravity, as for example, the shape of a mold when removed from the mold, the shape of an article as formed upon extrusion from an extruder, and the like. The degree of hardness of the solid cast composition can range from that of a fused solid block, which is relatively dense and hard, for example, like concrete, to a consistency characterized as being malleable and sponge-like, similar to caulking material.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a alkyl phenol ethoxylate-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

Compositions

The invention relates to moderately alkaline cleaning compositions for proteinaceous and fatty soil removal at low temperatures. Compositions are provided both with and without chlorine. In general the compositions of the invention may include one or more of the following: a polar media carrier, a source of alkalinity, a source of chlorine, a surfactant system, a water conditioning agent, hydrotrope, and the like. Some embodiments may also include additional functional materials, as desired, to give the composition certain properties (such as antimicrobial properties or corrosion protection additives). Below is a discussion of some example components that can be used in cleaning compositions in accordance with certain embodiments. Unless otherwise specified, the term composition shall mean a concentrate composition as opposed to a use composition.

Source of Alkalinity

Alkaline cleaner compositions are well known as those that contain alkali or alkaline earth metal borates, silicates, carbonates, hydroxides, phosphates and mixtures thereof. It is to be appreciated that phosphate includes all the broad class of phosphate materials, such as phosphates, pyrophosphates, polyphosphates (such as tripolyphosphate) and the like. Silicates include all of the usual silicates used in cleaning such as metasilicates, silicates and the like. The alkali or alkaline earth metals include such components as sodium, potassium, calcium, magnesium, barium and the like. It is to be appreciated that a cleaner composition can be improved by utilizing various mixtures and ratios of the borates, hydroxides, carbonates, phosphates, silicates and the like. For appropriate end uses, one of the phosphates may be used and not a carbonate. Conversely, silicates may be used and no phosphates used depending upon the end use of the cleaner composition. Chemically they are sodium hydroxide (NaOH, or caustic soda), potassium hydroxide (caustic potash), sodium carbonate (soda ash) or sodium hypochlorite (NaOCl) and sodium silicates and have a pH higher than 7.

Additional Source of Alkalinity

An additional alkalinity source may be provided to enhance cleaning of a substrate, improve soil removal, to increase the pH of the composition, or to perform other functions. The additional source of alkalinity can include any alkalinity producing material that is generally compatible with other components within the given composition. In some embodiments, the additional source of alkalinity can be fully ionizable within the composition. As discussed above, however, in at least some embodiments, as the level of fully ionizable sources of alkalinity within the composition is increased, the level of stability of any chlorine within the composition may fall.

Some examples of additional sources of alkalinity include alkali metal salts, alkali earth metal salts, ammoniums, protonated amines, protonated alkanol amines, or the like, and combinations or mixtures thereof.

According to the invention, the best protein removal for compositions including chlorine, the ratio of the chlorine to the alkaline portion is greater than 1:1, preferably 3:1 or greater, and most preferably 5:1 or greater where the active alkalinity would be present in the range of approximately 25-5000 ppm, preferably 25-1650 ppm, and most preferably 25-1000 ppm in cleaning solutions at use concentrations. For other non-chlorine low temperature cleaners, the active alkalinity should be present in the range of approximately 50-10000 ppm, preferably 100-5000 ppm, and most preferably 250-2000 ppm in cleaning solutions at use concentrations.

Source of Chlorine

Some of the formulations of the invention include a source of chlorine, active chlorine or hypochlorite ion. Some examples of classes of compounds that can act as sources of chlorine include any source that in a use solution results in available chlorine, such as hypochlorite, a chlorinated phosphate, a chlorinated isocyanurate, a chlorinated melamine, a chlorinated amide, and the like, or mixtures of combinations thereof.

Some specific examples of sources of chlorine can include sodium hypochlorite, potassium hypochlorite, calcium hypochlorite, lithium hypochlorite, chlorinated trisodium-phosphate, sodium dichloroisocyanurate, potassium dichloroisocyanurate, pentaisocyanurate, trichloromelamine, sulfondichloro-amide, 1,3-dichloro 5,5-dimethyl hydantoin, N-chlorosuccinimide, N,N'-dichloroazodicarbonimide, N,N'-chloroacetylurea, N,N'-dichlorobiuret, trichlorocyanuric acid and hydrates thereof, or combinations or mixtures thereof.

As discussed above, according to the invention optimized combinations of chlorine and alkalinity components for low temperature protein cleaning include a reversal of the traditional ratio of chlorine and alkalinity, namely a ratio of chlorine to alkalinity of greater than 1:1 on a percent weight basis. This combination provided superior cleaning at lower temperature (i.e. 50° F.) than a traditional chlorine alkaline cleaning composition with the reversed ratio for protein removal. In a preferred embodiment the ratio of chlorine to alkalinity is 3:1 or greater and in a most preferred embodiment the ratio is 5:1 or greater.

Some cleaning compositions according to the invention comprise:

(a) an alkaline portion containing alkaline materials selected from the group consisting of alkali or alkaline earth metal borate, silicate, carbonate, hydroxide, phosphate and mixtures and combinations thereof;

(b) a chlorine portion containing a source of chlorine such as a hypochlorite, a chlorinated phosphate, a chlorinated isocyanurate, a chlorinated melamine, a chlorinated amide, and the like, or mixtures and combinations thereof wherein the ratio of the chlorine portion to the alkaline portion is greater than 1:1, preferably 3:1 or greater, and most preferably 5:1.

Polar Carrier

The cleaning solutions of the invention include a polar carrier media, such as water and the like, or other chlorine compatible polar solvents, or mixtures and combinations thereof. In the cleaning solutions at use concentrations the polar carrier makes up the remainder of the composition once the amounts of the other ingredients have been determined.

Surfactant System of Long Chain Amine Oxides

According to the invention, for superior low temperature fatty soil removal, surfactants used should be of the Semi-Polar Nonionic Surfactant type such as amine oxides.

The semi-polar type of nonionic surface active agents is another class of nonionic surfactant useful in compositions of the present invention. The semi-polar nonionic surfactants include the amine oxides, phosphine oxides, sulfoxides and their alkoxylated derivatives.

Amine oxides are tertiary amine oxides corresponding to the general formula:

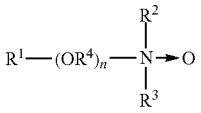

wherein the arrow is a conventional representation of a semi-polar bond; and $R^1$, $R^2$, and $R^3$ may be aliphatic, aromatic, heterocyclic, alicyclic, or combinations thereof. Preferably according to the invention, $R^1$ is a long alkyl radical with 14 to 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

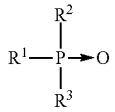

wherein the arrow is a conventional representation of a semi-polar bond; and R1 is an alkyl, alkenyl or hydroxyalkyl moiety ranging from 10 to 24 carbon atoms in chain length; and R2 and R3 are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide. Semi-polar nonionic surfactants useful herein also include the water soluble sulfoxide compounds which have the structure:

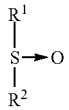

wherein the arrow is a conventional representation of a semi-polar bond; and, R1 is an alkyl or hydroxyalkyl moiety of 8 to 28 carbon atoms, from 0 to 5 ether linkages and from 0 to 2 hydroxyl substituents; and R2 is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

The semi-polar nonionic surfactants included within some of the compositions of the invention would have average carbon chain length in the range of 8-20 carbons, preferably 12-18 carbons, most preferably 14-16 carbons and be present in the range of approximately 0-10000 ppm, preferably 100-2000 ppm, and most preferably 250-1200 ppm in cleaning solutions at use concentrations. The semi-polar nonionic surfactant composition would consist of at least 20% of an alkyl chain length of 14-16 carbons, preferably 30% of an alkyl chain length of 14-16 carbons and most preferably greater than 40% of an alkyl chain length of 14-16 carbons.

Additional Materials

The compositions may also include additional materials such as additional functional materials, for example, an additional surfactant, a water conditioning agent, a hydrotrope, a chelating agent, a sequestering agent, a bleaching agent, a thickening agent, a gelling agent, a solubility modifier, a filler, a defoamer, an anti-redeposition agent, a threshold agent or system, an antimicrobial additive, a corrosion inhibitor, an aesthetic enhancing agent (i.e. dye, perfume, etc.) and the like, or combinations or mixtures thereof. Adjuvants and other additive ingredients will vary according to the type of composition being manufactured and can be included in the compositions in any amount. In at least some embodiments, any additional functional materials that are added to the composition are compatible with the other components within the composition. For example, because chlorine will be substantially present within some of the compositions, it may be useful that any additional materials be chlorine compatible. The following is a brief discussion of some examples of such additional materials.

Additional Surfactants

The cleaning compositions of the invention can further comprise a surfactant or in some cases an additional surfactant. This can include water soluble or water dispersible nonionic, semi-polar nonionic (supra), anionic, cationic, amphoteric, or zwitterionic surface-active agents; or any combination thereof. A typical listing of the classes and species of surfactants useful herein appears in U.S. Pat. No. 3,664,961 issued May 23, 1972, to Norris.

Nonionic Surfactants

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

1. Block polyoxypropylene-polyoxyethylene polymeric compounds based upon propylene glycol, ethylene glycol, glycerol, trimethylolpropane, and ethylenediamine as the initiator reactive hydrogen compound. Examples of polymeric compounds made from a sequential propoxylation and ethoxylation of initiator are commercially available under the trade names Pluronic® and Tetronico manufactured by BASF Corp.

Pluronic® compounds are difunctional (two reactive hydrogens) compounds formed by condensing ethylene oxide with a hydrophobic base formed by the addition of propylene oxide to the two hydroxyl groups of propylene glycol. This hydrophobic portion of the molecule weighs from 1,000 to 4,000. Ethylene oxide is then added to sandwich this hydrophobe between hydrophilic groups, controlled by length to constitute from about 10% by weight to about 80% by weight of the final molecule.

Tetronic® compounds are tetra-functional block copolymers derived from the sequential addition of propylene oxide and ethylene oxide to ethylenediamine. The molecular weight of the propylene oxide hydrotype ranges from 500 to 7,000; and, the hydrophile, ethylene oxide, is added to constitute from 10% by weight to 80% by weight of the molecule.

2. Condensation products of one mole of alkyl phenol wherein the alkyl chain, of straight chain or branched chain configuration, or of single or dual alkyl constituent, contains from 8 to 18 carbon atoms with from 3 to 50 moles of ethylene oxide. The alkyl group can, for example, be represented by diisobutylene, di-amyl, polymerized propylene, iso-octyl, nonyl, and di-nonyl. These surfactants can be polyethylene, polypropylene, and polybutylene oxide condensates of alkyl phenols. Examples of commercial compounds of this chemistry are available on the market under the trade names Igepal® manufactured by Rhone-Poulenc and Triton® manufactured by Union Carbide.

3. Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co.

4. Condensation products of one mole of saturated or unsaturated, straight or branched chain carboxylic acid having from 8 to 18 carbon atoms with from 6 to 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include:

5. Compounds from (1) which are modified, essentially reversed, by adding ethylene oxide to ethylene glycol to provide a hydrophile of designated molecular weight; and, then adding propylene oxide to obtain hydrophobic blocks on the outside (ends) of the molecule. The hydrophobic portion of the molecule weighs from 1,000 to 3,100 with the central hydrophile including 10% by weight to 80% by weight of the final molecule. These reverse Pluronics® are manufactured by BASF Corporation under the trade name Pluronic® R surfactants.

Likewise, the Tetronic® R surfactants are produced by BASF Corporation by the sequential addition of ethylene oxide and propylene oxide to ethylenediamine. The hydrophobic portion of the molecule weighs from 2,100 to 6,700 with the central hydrophile including 10% by weight to 80% by weight of the final molecule.

6. Compounds from groups (1), (2), (3) and (4) which are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Additional examples of effective low foaming nonionics include:

7. The alkylphenoxypolyethoxyalkanols of U.S. Pat. No. 2,903,486 issued Sep. 8, 1959 to Brown et al. and represented by the formula

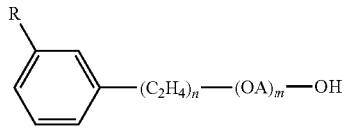

in which R is an alkyl group of 8 to 9 carbon atoms, A is an alkylene chain of 3 to 4 carbon atoms, n is an integer of 7 to 16, and m is an integer of 1 to 10.

The polyalkylene glycol condensates of U.S. Pat. No. 3,048,548 issued Aug. 7, 1962 to Martin et al. having alternating hydrophilic oxyethylene chains and hydrophobic oxypropylene chains where the weight of the terminal hydrophobic chains, the weight of the middle hydrophobic unit and the weight of the linking hydrophilic units each represent about one-third of the condensate.

The defoaming nonionic surfactants disclosed in U.S. Pat. No. 3,382,178 issued May 7, 1968 to Lissant et al. having the general formula $Z[(OR)_nOH]_z$ wherein Z is alkoxylatable material, R is a radical derived from an alkaline oxide which can be ethylene and propylene and n is an integer from, for example, 10 to 2,000 or more and z is an integer determined by the number of reactive oxyalkylatable groups.

The conjugated polyoxyalkylene compounds described in U.S. Pat. No. 2,677,700, issued May 4, 1954 to Jackson et al. corresponding to the formula $Y(C_3H_6O)_n(C_2H_4O)$ m H wherein Y is the residue of organic compound having from 1 to 6 carbon atoms and one reactive hydrogen atom, n has an average value of at least 6.4, as determined by hydroxyl number and m has a value such that the oxyethylene portion constitutes 10% to 90% by weight of the molecule.

The conjugated polyoxyalkylene compounds described in U.S. Pat. No. 2,674,619, issued Apr. 6, 1954 to Lundsted et al. having the formula $Y[(C_3H_6O_n(C_2H_4O)_mH]_x$ wherein Y is the residue of an organic compound having from 2 to 6 carbon atoms and containing x reactive hydrogen atoms in which x has a value of at least 2, n has a value such that the molecular weight of the polyoxypropylene hydrophobic base is at least 900 and m has value such that the oxyethylene content of the molecule is from 10% to 90% by weight. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula: $P[(C_3H_6O)_n(C_2H_4O)_mH]_x$ wherein P is the residue of an organic compound having from 8 to 18 carbon atoms and containing x reactive hydrogen atoms in which x has a value of 1 or 2, n has a value such that the molecular weight of the polyoxyethylene portion is at least 44 and m has a value such that the oxypropylene content of the molecule is from 10% to 90% by weight. In either case the oxypropylene chains may contain optionally, but advantageously, small amounts of ethylene oxide and the oxyethylene chains may contain also optionally, but advantageously, small amounts of propylene oxide.

8. Polyhydroxy fatty acid amide surfactants suitable for use in the present compositions include those having the structural formula $R^2CONR^1Z$ in which: $R^1$ is H, $C_1$-$C_4$ hydrocarbyl, 2-hydroxy ethyl, 2-hydroxy propyl, ethoxy, propoxy group, or a mixture thereof; R is a $C_5$-$C_3$ 1 hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

9. The alkyl ethoxylate condensation products of aliphatic alcohols with from 0 to 25 moles of ethylene oxide are suitable for use in the present compositions. The alkyl chain of the aliphatic alcohol can either be straight or branched, primary or secondary, and generally contains from 6 to 22 carbon atoms.

10. The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ ethoxylated fatty alcohols with a degree of ethoxylation of from 3 to 50.

11. Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

12. Fatty acid amide surfactants suitable for use in the present compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or $—(C_2H_4O)_xH$, where x is in the range of from 1 to 3.

13. A useful class of non-ionic surfactants includes the class defined as alkoxylated amines or, most particularly, alcohol alkoxylated/aminated/alkoxylated surfactants. These non-ionic surfactants may be at least in part represented by the general formulae:

$$R^{20}—(PO)_sN\text{-}(EO)_tH,$$

$$R^{20}—(PO)_sN\text{-}(EO)_tH(EO)_tH, \text{ and}$$

$$R^{20}—N(EO)_tH;$$

in which $R^{20}$ is an alkyl, alkenyl or other aliphatic group, or an alkyl-aryl group of from 8 to 20, preferably 12 to 14 carbon atoms, EO is oxyethylene, PO is oxypropylene, s is 1 to 20, preferably 2-5, t is 1-10, preferably 2-5, and u is 1-10, preferably 2-5. Other variations on the scope of these compounds may be represented by the alternative formula:

$$R^{20}—(PO)_v—N[(EO)_wH][(EO)_zH]$$

in which $R^{20}$ is as defined above, ν is 1 to 20 (e.g., 1, 2, 3, or 4 (preferably 2)), and w and z are independently 1-10, preferably 2-5.

These compounds are represented commercially by a line of products sold by Huntsman Chemicals as nonionic surfactants. A preferred chemical of this class includes Surfonic™ PEA 25 Amine Alkoxylate.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents was described supra.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore favored additions to heavy duty detergent compositions. Generally, however, anionics have high foam profiles which limit their use alone or at high concentration levels in cleaning systems such as CIP circuits that require strict foam control. Anionic surface active compounds are useful to impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution. The simplest cationic amines, amine salts and quaternary ammonium compounds can be schematically drawn thus:

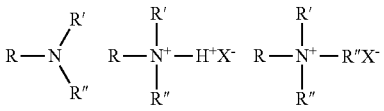

in which, R represents a long alkyl chain, R', R", and R' may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

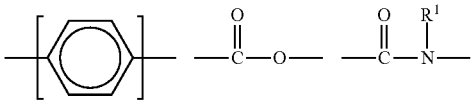

-continued

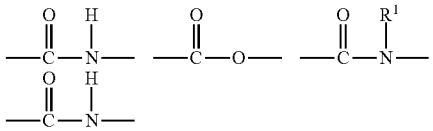

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group including, but not limited to:

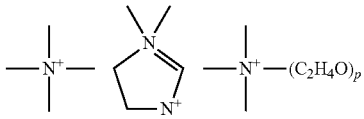

p=about 1 to 12

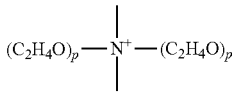

p=about 1 to 12

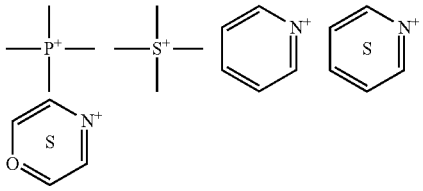

or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

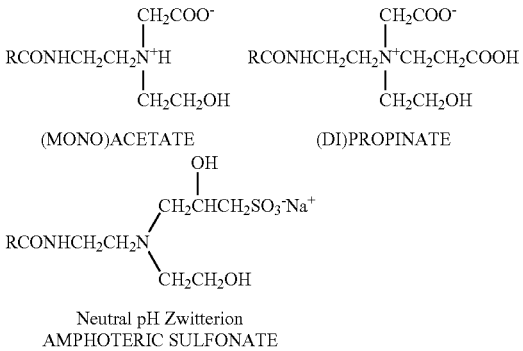

wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R.dbd.$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

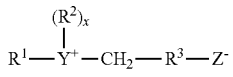

wherein R1 contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; R.sup.2 is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

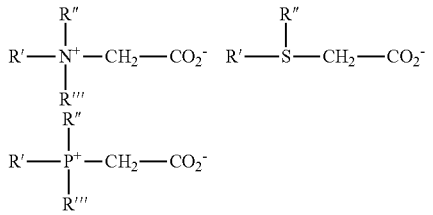

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R1)_2N.sup.+R^2SO^3$—, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

The composition of additional surfactant can be present in the range of approximately 0-10000 ppm in cleaning solutions at use concentrations.

Water Conditioning Agent

A water conditioning agent aids in removing metal compounds and in reducing harmful effects of hardness components in service water. Exemplary water conditioning agents include chelating agents, sequestering agents and inhibitors. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing compositions during a cleaning application. A water conditioning agent can effectively complex and remove such compounds or cations from soiled surfaces and can reduce or eliminate the inappropriate interaction with active ingredients including the nonionic surfactants and anionic surfactants of the invention. Both organic and inorganic water conditioning agents are common and can be used. Inorganic water conditioning agents include such compounds as sodium tripolyphosphate and other higher linear and cyclic polyphosphates species. Organic water conditioning agents include both polymeric and small molecule water conditioning agents. Organic small molecule water conditioning agents are typically organocarboxylate compounds or organophosphate water conditioning agents. Polymeric inhibitors commonly comprise polyanionic compositions such as polyacrylic acid compounds. Small molecule organic water conditioning agents include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available.

The composition of a water conditioning agent can be present in the range of approximately 0-5000 ppm in cleaning solutions at use concentrations.

Anti-Redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and the like.

The composition of an anti-redeposition agent can be present in the range of approximately 0-5000 ppm in cleaning solutions at use concentrations.

Hydrotrope

The compositions of the invention may optionally include a hydrotrope, coupling agent, or solubilizer that aides in compositional stability, and aqueous formulation. Functionally speaking, the suitable couplers which can be employed are non-toxic and retain the active ingredients in aqueous solution throughout the temperature range and concentration to which a concentrate or any use solution is exposed.

Any hydrotrope coupler may be used provided it does not react with the other components of the composition or negatively affect the performance properties of the composition. Representative classes of hydrotropic coupling agents or solubilizers which can be employed include anionic surfactants such as alkyl sulfates and alkane sulfonates, linear alkyl benzene or naphthalene sulfonates, secondary alkane sulfonates, alkyl ether sulfates or sulfonates, alkyl phosphates or phosphonates, dialkyl sulfosuccinic acid esters, sugar esters (e.g., sorbitan esters), amine oxides (mono-, di-, or tri-alkyl) and $C_8$-$C_{10}$ alkyl glucosides. Preferred coupling agents for use in the present invention include n-octanesulfonate, available as NAS 8D from Ecolab Inc., n-octyl dimethylamine oxide, and the commonly available aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof. Other preferred hydrotropes include nonionic surfactants of $C_6$-$C_{24}$ alcohol alkoxylates (alkoxylate means ethoxylates, propoxylates, butoxylates, and co-orterpolymer mixtures thereof) (preferably $C_6$-$C_{14}$ alcohol alkoxylates) having 1 to about 15 alkylene oxide groups (preferably about 4 to about 10 alkylene oxide groups); $C_6$-$C_{24}$ alkylphenol alkoxylates (preferably $C_8$-$C_{10}$ alkylphenol alkoxylates) having 1 to about 15 alkylene oxide groups (preferably about 4 to about 10 alkylene oxide groups); $C_6$-$C_{24}$ alkylpolyglycosides (preferably $C_6$-$C_{20}$ alkylpolyglycosides) having 1 to about 15 glycoside groups (preferably about 4 to about 10 glycoside groups); $C_6$-$C_{24}$ fatty acid ester ethoxylates, propoxylates or glycerides; and $C_4$-$C_{12}$ mono or dialkanolamides.

The composition of a hydrotrope can be present in the range of approximately 0-10000 ppm in cleaning solutions at use concentrations.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. An iminodisuccinate (available commercially from Bayer as IDS') may be used as a chelating agent.

The composition of a chelating/sequestering agent can be present in the range of approximately 0-10000 ppm in cleaning solutions at use concentrations.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like. Examples of condensed phosphates useful in the present composition include sodium and potassium orthophosphate, sodium and potassium pyrophosphate, sodium tripolyphosphate, sodium hexametaphosphate, and the like. The composition may include a phosphonate such as 1-hydroxyethane-1,1-diphosphonic acid, 2-phosphonobutane-1,2,4 tricarboxylic acid, and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Thickening Agent

In some embodiments, a thickening agent may be included. Some examples of thickeners include soluble organic or inorganic thickener material. Some examples of inorganic thickeners include clays, silicates and other well-known inorganic thickeners. Some examples of organic thickeners include thixotropic and non-thixotropic thickeners. In some embodiments, the thickeners have some substantial proportion of water solubility to promote easy removability. Examples of useful soluble organic thickeners for the compositions of the invention comprise carboxylated vinyl polymers such as polyacrylic acids and alkali metal salts thereof, and other similar aqueous thickeners that have some substantial proportion of water solubility. The composition of a thickening agent can be present in the range of approximately 0-10000 ppm in cleaning solutions at use concentrations.

Bleaching Agents

The composition may include a bleaching agent in addition to or in conjunction with the source of chlorine. Bleaching agents for lightening or whitening a substrate, include bleaching compounds capable of liberating an non-chlorine active halogen species, such as iodine and iodine containing complexes, $Br_2$, and/or —$OBr^-$, under conditions typically encountered during the cleansing process. A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. The composition of a non-chlorine bleaching agent can be present in the range of approximately 0-10000 ppm in cleaning solutions at use concentrations.

Dye or Odorant

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like. Fragrances or perfumes that may be included in the compositions include, for example, terpenoids such as citronellol, aldehydes such as amyl cinnamaldehyde, a jasmine such as C1S-jasmine orjasmal, vanillin, and the like.

Antimicrobial Agent

The compositions may optionally include an antimicrobial agent or preservative. Antimicrobial agents are chemical compositions that can be used in the compositions to prevent microbial contamination and deterioration of commercial products material systems, surfaces, etc. Generally, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds. The given antimicrobial agent depending on chemical composition and concentration may simply limit further proliferation of numbers of the microbe or may destroy all or a substantial proportion of the microbial population. The terms "microbes" and "microorganisms" typically refer primarily to bacteria and fungus microorganisms. In use, the antimicrobial agents are formed into the final product that when diluted and dispensed using an aqueous stream forms an aqueous disinfectant or sanitizer composition that can be contacted with a variety of surfaces resulting in prevention of growth or the killing of a substantial proportion of the microbial population. Common antimicrobial agents that may be used include phenolic antimicrobials such as pentachlorophenol, orthophenylphenol; halogen containing antibacterial agents that may be used include sodium trichloroisocyanurate, sodium dichloroisocyanurate (anhydrous or dihydrate), iodine-poly(vinylpyrolidin-onen) complexes, bromine compounds such as 2-bromo-2-nitropropane-1,3-diol; quaternary antimicrobial agents such as benzalconium chloride, cetylpyridiniumchloride; amines and nitro containing antimicrobial compositions such as hexahydro-1,3,5-tris(2-hydroxyethyl)-s-triazine, dithiocarbamates such as sodium dimethyldithiocarbamate, and a variety of other materials known in the art for their microbial properties. Antimicrobial agents may be encapsulated to improve stability and/or to reduce reactivity with other materials in the detergent composition. When an antimicrobial agent or preservative is incorporated into the composition, the composition of an antimicrobial agent can be present in the range of approximately 0-10000 ppm in cleaning solutions at use concentrations.

Corrosion Inhibitor A corrosion inhibitor is a chemical compound that, when added in small concentrations, stops or slows down corrosion, otherwise referred to as oxidation of metals and alloys. Examples of suitable corrosion inhibitors include those that inhibit corrosion, but that do not significantly interfere with the cleaning activity of the composition. Corrosion inhibitors which may be optionally added to the composition of the invention include silicates, phosphate, magnesium and/or zinc ions. Preferably, the metal ions are provided in a water-soluble form. Examples of useful water-soluble forms of magnesium and zinc ions are the water-soluble salts thereof including the chlorides, nitrates and sulfates of the respective metals. Some preferred corrosion inhibitors include sodium metasilicate, sodium bicarbonate, potassium silicate and/or sodium silicate.

The compositions of the invention may also contain additional typically nonactive materials, with respect to cleaning properties, generally found in liquid pretreatment or detergent compositions in conventional usages. These ingredients are selected to be compatible with the materials of the invention and include such materials as fabric softeners, optical brighteners, soil suspension agents, germicides, viscosity modifiers, gelling agents, inorganic carriers, solidifying agents and the like.

Methods of Making

The cleaning compositions can be made by combining a source of alkalinity; a source of surfactant; a source of chlorine (optionally); and a polar carrier, as each of these components are described above. The compositions of cleaning solutions can be formed from concentrates of component mixtures or mixed individually at the point of use. A concentrate of a cleaning solution described in this invention may be in the form of a single phase or multiphase liquid, gel, paste, solid, structured liquid, a dispersion, a colloidal suspension, and the like. A concentrate used to form the compositions of cleaning solutions described in this invention can be uniform or non-uniform. The active components in the composition can be obtained by dilution of a concentrate with the polar component typically being water commonly available from tap or service water. The concentrates and diluted use solutions may be useful as cleaners, destainers, sanitizers, and the like, for example, for surfaces, laundry, warewashing, cleaning-in-place, medical cleaning and sanitizing, vehicle care, floors, and the like.

The following tables show some example compositions in accordance with the invention, subject to the alkaline/chlorine ratios and active alkaline concentration as described supra. It should be understood that these formulations are given by way of example only.

TABLE 1

Sample chlorinated low temperature protein soil removal compositions of the invention

| Composition | Range (ppm) | Preferred Range (ppm) | Most preferred (ppm) |
|---|---|---|---|
| Water conditioning agent/Soil anti-re deposition agent | 0-1500 | 0-1500 | 0-1500 |
| Active Alkalinity | 25-5000 | 25-1650 | 25-1000 |
| Hydrotrope | 0-1500 | 0-1500 | 0-1500 |
| Surfactant | 0-2000 | 0-2000 | 0-2000 |
| Active Chlorine | 25-5000 | 75-5000 | 125-5000 |

TABLE 2

Sample non-chlorinated low temperature protein soil removal compositions of the invention

| Composition | Range (ppm) | Preferred Range (ppm) | Most preferred (ppm) |
|---|---|---|---|
| Water conditioning agent Soil anti-re deposition agent | 0-1500 | 0-1500 | 0-1500 |
| Active Alkalinity | 50-10000 | 100-5000 | 250-2000 |
| Hydrotrope | 0-1500 | 0-1500 | 0-1500 |
| Surfactant | 0-2000 | 0-2000 | 0-2000 |

TABLE 3

Sample chlorinated low temperature protein removal with optimized fatty soil surfactant system

| Composition | Range (ppm) | Preferred Range (ppm) | Most preferred (ppm) |
|---|---|---|---|
| Water conditioning agent/Soil anti-re deposition agent | 0-1500 | 0-1500 | 0-1500 |
| Active Alkalinity | 25-5000 | 25-1650 | 25-1000 |
| Hydrotrope | 0-1500 | 0-1500 | 0-1500 |
| Surfactant (C-14 Amine Oxide) | 50-2000 | 50-2000 | 50-2000 |
| Active Chlorine | 25-5000 | 75-5000 | 125-5000 |

TABLE 4

Sample non-chlorinated low temperature protein removal with optimized fatty soil surfactant system

| Composition | Range (ppm) | Preferred Range (ppm) | Most preferred (ppm) |
|---|---|---|---|
| Water conditioning agent Soil anti-re deposition agent | 0-1500 | 0-1500 | 0-1500 |
| Active Alkalinity | 50-10000 | 100-5000 | 250-2000 |
| Hydrotrope | 0-1500 | 0-1500 | 0-1500 |
| Surfactant (C-14 Amine Oxide) | 50-2000 | 50-2000 | 50-2000 |

EXAMPLES

Formulations were prepared according to the invention and tested using the following general procedure.

Cleaning Procedure:

1. Ground chicken (60% protein and 40% fat) and ground chicken breast (protein only soil) were produced by brushing onto 3"×5" stainless steel coupons and air dried at room temperature overnight to produce a soil weight of 0.0200 g, weighed on an analytical balance and weight recorded. Beef suet and lard soils were produced by onto 3"×5" stainless steel coupons to produce a soil weight of 0.0500 g, weighed on an analytical balance and weight recorded.

2. Cleaning was carried out with soiled stainless steel coupons submerged in 1 L beaker with the soiled side of the coupon facing down at the desired temperature with 100 rpm stirring with a Teflon stir bar.

3. The coupon is removed from beaker and rinsed with DI water from a regulated faucet stream while holding coupon at 45° angle to the water stream held 6" below the faucet. During the rinse the coupon was moved from side to side 10 times at a rate of approximately one time per second. The water stream only impinged directly on the top unsoiled portion of the coupon relying on the subsequently created water flow to rinse removable soil from the coupon.

4. The coupon was drained vertically until no longer dripping and then left to dry overnight in room temperature air on a paper towel surface with the soil facing upwards.

5. The coupons were then weighed on an analytical balance, the weight recorded and the weight difference of soiled versus cleaned coupon calculated.

6. A Coomassie Blue staining method was used to treat two of the four replicates to demonstrate protein residual. (Dissolve 0.1 g Coomassie Brilliant Blue G-250 in 50 ml (39.45 g) 95% ethanol, add 100 ml (158.23 g) 85% (w/v) phosphoric acid. Dilute to 1 liter.) Plates were dipped in dye, rinsed with distilled water to de-stain and dried. (The method stains the protein blue.) A Sudan Red IV staining was used to treat two of the four replicates to demonstrate fat residual. (Dissolve 0.1 g Sudan IV into 50 ml (39.50 g) acetone. Add 35 ml (27.62 g) 100% ethanol and 15 ml distilled water. Filter solution using Whatman #1 or #2 filter paper.) Plates were dipped in dye and let stand for about one minute. The Sudan Red Iv plates are de-stained by rinsing with a 35% ethanol solution followed by a distilled water rinse. (The method stains the fat red.)

7. Stained/De-stained coupons were scanned on conventional color scanner and images were stored for image analysis.

Weight Analysis:

Soil removal by weight %=(soiled coupon weight−post-cleaning coupons weight)/(soiled coupon weight−plain coupon weight)×100 The weight analysis cannot distinguish between % removal of protein versus % removal of fat components of the soil. Higher bulk soil % removal demonstrates the cleaning solutions ability to remove higher levels of soil. %. The soil removal by weight % method represents the ability of the cleaning solution to emulsify and remove the bulk soil on a coupon but does not have the ability to show if the surface is completely cleaned (a thin layer of residual soil may still remain as determined by image analysis described below).

Image Analysis:

Fiji Image J (open source) imaging analysis software was used to analyze the coupons after cleaning and staining procedures using identical color adjustment factors to distinguish between area % of colored sections (still containing soil) and area % of non-colored sections (where soil has been removed by the cleaning process). Cleaned area % was measured on each coupon. Higher cleaned area % indicates better cleaning performance. Image analysis demonstrates amount of coupon where soil was completely removed. In food production cleaning operations, for example, even small residual coatings of food soils can be sites for further soil buildup as well as harborage points for microbial contamination. Determination that an area is 100% cleaned of protein and/or fat soils differs from a weight analysis which only measures bulk removal but not complete removal from a soiled surface.

Example 1

The dependence of protein removal on active alkaline level in solution was studied using protein only soil at 50° F. at different hypochlorite concentrations (400, 900 and 1500 ppm). Table 5 shows the results of a test run as described above. Solutions with 400, 900 and 1500 ppm hypochlorite at lower active alkalinity at alkaline pH's cleaned the protein soil better than at higher active alkaline concentrations at all three concentrations. Protein only soils appear to be removed preferably with lower active alkalinity. It was very surprising to find out that excess amount of active alkalinity makes these protein soils more difficult to remove even with varying hypochlorite concentrations.

TABLE 5

Effect of additional NaOH on protein removal at various levels of active chlorine at 50° F.

| NaOCl level (ppm) | Additional NaOH (ppm) | pH | Soil Removal by wt % (Weight Analysis) | Cleaned Area % (Image Analysis) |
|---|---|---|---|---|
| 900 ppm | 0 | 8 | 90% | 76% |
| | 25 | 10 | 96% | 95% |
| | 62.5 | 11 | 101% | 93% |
| | 1000 | 12.5 | 91% | 54% |
| 1500 ppm | 0 | 8 | 45% | 92% |
| | 0 | 9 | 101% | 99% |
| | 25 | 10 | 102% | 100% |
| | 62.5 | 11 | 104% | 100% |
| | 500 | 12 | 103% | 98% |
| | 1000 | 12.6 | 101% | 73% |
| | 2000 | 12.8 | 102% | 59% |
| 400 ppm | 0 | 7 | 26% | 0% |
| | 0 | 8 | 45% | 3% |
| | 15 | 9.4 | 86% | 1% |
| | 62.5 | 11 | 85% | 0% |
| | 500 | 12 | 72% | 0% |
| | 1000 | 12.5 | 67% | 0% |
| | 2000 | 12.8 | 64% | 0% |

Example 2

To determine the cleaning capacities on protein and fat mixtures, a standardized testing procedure at 50° F. using the ground chicken soils (60% protein+40% fat) on stainless steel coupons and measuring results with weight analysis as well as staining analysis techniques as described in the testing procedure above.

The following inventive compositions I and II were compared against a commercially available alkali chlorine cleaning composition labeled as Comparison Composition A as described in Table 6 as concentrates and Table 7 as active formulas in use concentrations. Table 8 shows the ratio of the chlorine to the active alkalinity for these three formulas.

TABLE 6

| | Comparison composition A | Inventive composition I | Inventive composition II | Inventive composition III | Inventive composition IV | Inventive composition V |
|---|---|---|---|---|---|---|
| Sodium hydroxide, 50% | 20.5% | 4% | 2.65% | 6.87% | 2.65% | 6.87% |
| Sodium hypochlorite, 10% | 25% | 25% | 35% | | 35% | |
| Water conditioning agents | 5% | 5% | 2.5% | 2.5% | 2.5% | 2.5% |
| hydrotrope | 5% | 1% | 1% | 1% | 1% | 1% |
| Cocoamine oxide (i.e. Barlox 12) | 8% | 8% | 8% | 8% | | 4% |
| C14 amine oxide (i.e. Barlox 14) | | | | | 8% | 4% |
| Other ingredients | Add up to 100% | Add up to 100% | Add up to 100% | Add up to 100% | Add up to 100% | Add up to 100% |

TABLE 7

| | Comparison Composition A (ppm) | Inventive Composition I (ppm) | Inventive Composition II (ppm) | Inventive Composition III (ppm) | Inventive Composition IV (ppm) | Inventive Composition V (ppm) |
|---|---|---|---|---|---|---|
| Sodium Hydroxide | 3227 | 236 | 236 | 1001 | 236 | 1001 |
| Sodium hypochlorite | 906 | 906 | 1269 | | 1269 | |
| Water conditioning agents | 1161 | 1161 | 581 | 581 | 581 | 581 |
| Hydrotrope | 725 | 145 | 145 | 145 | 145 | 145 |
| Cocoamine oxide (i.e. Barlox 12) | 870 | 870 | 870 | 870 | | 435 |
| C14 amine oxide (i.e. Barlox 14) | | | | | 870 | 435 |

TABLE 8

| | Comparison Composition A | Inventive Composition I | Inventive Composition II |
|---|---|---|---|
| Ratio of Active NaOCl/NaOH | 0.28 | 3.84 | 5.38 |

The results of these cleaning experiments are shown in FIGS. 1 and 2. FIG. 1 is a graph of the soil removal results from stainless steel coupon cleaning experiments using weight analysis for Comparison Composition A and Inventive Compositions I and II on a protein and fat mixed soil at 50° F. Weight analysis demonstrates the ability of the cleaning solution to dissolve the bulk soil from a hard surface but not necessarily complete removal from any portion of that surface. Cleaning with Inventive Composition I and II both showed higher wt % removed soil compared to the Comparison Composition A.

FIG. 2 is a graph of the image analysis results from the same cleaning experiment used in FIG. 1. Protein and fat staining methods were used on the cleaned coupons and results for each staining method described above are summed for each cleaning composition (each staining method resulting in 100% maximum representing complete removal of protein soil or fat soil and a total of 200% maximum for complete removal of both protein and fat soils from a coupon surface). As the staining techniques will detect even small residuals of protein or fat depending on the technique, cleaned area % represents the area of the surface where no detectable soil was observed in the imaging analysis. Cleaning with Inventive Composition I and II both showed higher cleaned area % for protein+fat soils than did the Comparison Composition A.

Example 3

Table 9 shows the effect cleaning solutions with increasing the soil load using a protein and fat mixture at 50° F. Inventive composition II is demonstrated to remove bulk soil better than the Comparison Composition A.

TABLE 9

Comparison between Composition A and Inventive Composition II with increased soil loads

| soil load | chemistries | soil removal by wt % |
|---|---|---|
| 0.02 g | Comparison Composition A | 82% |
| | Inventive Composition II | 98% |
| 0.04 g | Comparison Composition A | 45% |
| | Inventive Composition II | 69% |
| 0.08 g | Comparison Composition A | 23% |
| | Inventive Composition II | 40% |

Example 4

Optimal NaOH Level for Non-Chlorinated Low Temperature Cleaning

The optimized alkalinity level for a protein and fat mixed soil removal with surfactant at low temperature is around 500-1000 ppm. Cleaning solutions were prepared according to the invention with no chlorine and varying amounts of alkalinity on soil removal using the test protocol and procedures described supra. As can be seen additional alkalinity beyond 2000 ppm does not improve cleaning, similarly alkalinity levels below 250 ppm do not provide satisfactory cleaning. Results are depicted FIG. 3.

FIG. 3 is a graph of image analysis on coupons cleaned by various levels of alkalinity in the presence of 870 ppm surfactant at 50° F. on protein and fat mixed soils. Cleaning performance increased while increasing active alkalinity level until 1000-2000 ppm. Additional alkalinity does not improve cleaning but decreased the performance.

Example 5

Development of Low Temperature Surfactant System

It was found that amine oxide is one of the best performing surfactants towards fat removal at a relatively low temperature. It was also found that longer alkyl chain amine oxide (i.e. C14 etc.) works better than shorter amine oxide (i.e. C12 etc.). The better performing longer chain amine oxide (i.e. C14 amine oxide) compensated the lack of alkalinity on fat removal at low temp.

FIG. 4 is a graph of soil removal weight analysis on fat (beef suet) at 80° F. by using different types of surfactants at active level of 870 ppm each. Surfactants Amine Oxide (i.e. Barlox 12), Alkyldiphenyloxide Disulfonate (i.e. Dowfax 3B2), Linear Alkylbenzene Sulfonate (i.e. LAS), Sodium Lauryl Sulfate (i.e. SLS), Sodium Lauryl Ether Sulfate (i.e. SLES), Secondary Alkyl Sulfate (i.e. SAS), Sulfosuccinate (i.e. Monawet MO 70E) were tested. The amine oxide type surfactant (i.e. Barlox 12) had far superior fatty soil removal performance compared to other categories.

FIG. 5 is a graph of soil removal weight analysis on fat (lard) at 110 or 120° F. by amine oxide surfactants containing various alkyl chain lengths. Surfactants tested here are from Lonza. FMB AM-8 contains mainly alkyl chain of 8 carbons. Barlox 10 contains mainly alkyl chain of 10 carbons. Barlox 12 contains mainly alkyl chain of 12 carbons. Barlox 14 and 16s contain mainly alkyl chain of 14 and 16 carbons, respectively.

Example 6

Table 10 shows the cleaning results from Inventive Composition II and IV (chlorinated alkaline cleaners) and Inventive Composition III and V (non-chlorinated alkaline cleaners) both using an optimized surfactant system are compared to Comparison Composition A. (These formulas are shown in Table 7.)

TABLE 10

| | Cleaning Temperature (° F.) | Comparison Composition A | Inventive Composition II | Inventive Composition III | Inventive Composition IV | Inventive Composition V |
|---|---|---|---|---|---|---|
| Protein and fat mixed soil removal (Weight Analysis) | 50 | 79% | 98% | 90% | 97% | 89% |
| Fat (Lard) removal (Weight Analysis) | 80 | 19%[a], 36%[b] | 20%[a] | 20%[b] | 50%[a] | 41%[b] |

[a]performed on the same day, same batch of coupons
[b]performed on a separate day, same batch of coupons.

The results clearly show that cleaning composition comprising longer chain amine oxide in Composition IV significantly improved the fat removal performance compared to a shorter chain amine oxide containing composition in Composition II, and Composition IV even showed better fat removal compared to Comparison Composition A containing a higher alkaline concentration.

Inventive Composition III and V are alkaline cleaning compositions with optimized alkalinity level for protein removal at low temp. Composition V comprises a longer alkyl chain amine oxide (i.e. C14 amine oxide) with the short alkyl chain C12 amine oxide, while composition III only has the shorter alkyl chain amine oxide (i.e. cocoamine oxide).

The results show the lack of performance of a low alkaline level cleaning composition (i.e. Composition III) compared to a high alkaline level composition (i.e. Composition A) for fat removal at a low temp. However, the longer alkyl chain amine oxide in Inventive Composition V compensated the lack of performance in Composition III, and it matched or exceeded the fat removal performance of Composition A.

Protein soil removal profiles were also compared as also shown in Table 10. Inventive Compositions IV and V maintained the good protein cleaning performance compared to Composition II and III respectively and matched or exceeded Composition A on both protein and fat removal performance as shown earlier.

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A non-chlorine alkaline cleaning composition in use concentration capable of removing proteinaceous soils and/or fatty soils or mixtures thereof at temperatures of less than 100° F. comprising:

from about 250 ppm to about 2000 ppm of an active alkalinity source, wherein said alkaline source comprises one or more of an alkali or alkaline earth metal borate, silicate, carbonate, hydroxide, or phosphate; and from about 50 ppm to about 2000 ppm of a $C_{14}$-$C_{16}$ dimethyl amine oxide surfactant.

2. The cleaning composition of claim 1 further comprising one or more of the following: a water conditioning agent, a hydrotrope, an antimicrobial agent, a gelling agent and/or a metal corrosion inhibiting agent.

* * * * *